United States Patent [19]

Cox

[11] 4,418,928

[45] Dec. 6, 1983

[54] ICE SKATE

[76] Inventor: Michael W. Cox, P.O. Box 2, Alamo, Calif. 94507

[21] Appl. No.: 264,454

[22] Filed: May 18, 1981

[51] Int. Cl.[3] ..... A63C 1/30

[52] U.S. Cl. ..... 280/11.14; 280/7.13; 280/11.18; 280/28

[58] Field of Search ..... 280/7.13, 11.18, 11.14, 280/11.12, 28, 12 AB; D21/225 X

[56] References Cited

U.S. PATENT DOCUMENTS

| | | | |
|---|---|---|---|
| 150,896 | 5/1874 | See | 280/11.18 |
| 255,161 | 3/1882 | Gault | 280/11.18 |
| 330,133 | 11/1885 | Lapp | 280/7.13 |
| 1,830,514 | 11/1931 | Joslin | 280/7.13 |
| 2,454,321 | 11/1948 | Howard | 280/7.13 |
| 4,116,455 | 9/1978 | Dorson | 280/28 |
| 4,328,627 | 5/1982 | Sanders | 280/7.13 |

*Primary Examiner*—David M. Mitchell
*Assistant Examiner*—Joseph McCarthy
*Attorney, Agent, or Firm*—Harris Zimmerman; Howard Cohen

[57] ABSTRACT

An ice skate that provides exceptional lateral stability includes a boot having a sole plate extending longitudinally between the toe portion and the heel portion of the boot. A pair of adjustable shock absorbing mounting assemblies is joined to the toe portion and the heel portion of the sole plate. A pair of ice engaging members is provided, each secured to one of the shock absorber mounting assemblies. The ice engaging members extend transversely with respect to the longitudinal axis of the boot to provide high lateral stability. Projecting downwardly from the lower surfaces of the ice engaging members is a plurality of laterally spaced, longitudinally extending ribs which are adapted to slide on ice.

10 Claims, 5 Drawing Figures

ICE SKATE

BACKGROUND OF THE INVENTION

The following U.S. patents represent the closest known prior art:

U.S. Pat. No. Des. 250,490,
U.S. Pat. No. Des. 254,201,
U.S. Pat. No. Des. 249,973,
U.S. Pat. No. Des. 248,583,
U.S. Pat. No. Des. 53,047,
U.S. Pat. No. Des. 50,580,
U.S. Pat. No. Des. 45,311,
U.S. Pat. No. Des. 43,766,
U.S. Pat. No. Des. 43,766,
U.S. Pat. No. Des. 43,063,
U.S. Pat. No. Des. 33,890,
U.S. Pat. No. Des. 50,580,
U.S. Pat. No. Des. 31,052,
U.S. Pat. No. Des. 22,951,
U.S. Pat. No. Des. 95,466,
U.S. Pat. No. Des. 102,779,
U.S. Pat. No. Des. 93,618,
U.S. Pat. No. Des. 85,009,
U.S. Pat. No. Des. 112,078,
U.S. Pat. No. Des. 183,217,
U.S. Pat. No. Des. 144,605,
U.S. Pat. No. Des. 135,462,
U.S. Pat. No. Des. 53,068,
U.S. Pat. No. Des. 10,380,
U.S. Pat. No. Des. 182,518,
U.S. Pat. No. Des. 186,178,
U.S. Pat. No. Des. 253,670,
U.S. Pat. No. 3,879,047,
U.S. Pat. No. Des. 135,462,
U.S. Pat. No. 2,642,291,
U.S. Pat. No. 2,561,743,
U.S. Pat. No. Des. 245,800,
U.S. Pat. No. Des. 220,912,
U.S. Pat. No. Des. 33,931.

The typical ice skate known in the prior art generally includes a single narrow blade extending longitudinally and depending subjacently from a shoe or boot secured to the foot of the skater. Although this construction suffices for a great number of skaters, it is well recognized that many individuals are not capable of using and enjoying the typical single blade skate.

The single blade skate establishes a very narrow support base upon which a comparatively wide load must be supported. As a result, there is an inherent instability in this overall arrangement. This instability can be overcome by individuals having relatively strong and rigid ankle joints, as well as a keen sense of balance. For an individual lacking these attributes, skating can be a perilous and unpleasant pastime.

There are known in the prior art various skate constructions which attempt to overcome the deficiencies of the single blade skate. These constructions generally comprise various forms of double blade skates in which a pair of longitudinally extending blades is laterally spaced to provide a wider base of support. However, the effect of enhanced stability is created only when both of the blades are in contact with the ice. Due to the fact that the pair of blades is generally not widely spaced apart, an individual having weak ankles will cause the skate to roll about a longitudinal axis, resulting in only one blade contacting the ice. Thus the skater still will experience severe problems in balance and control.

SUMMARY OF THE PRESENT INVENTION

The present invention generally comprises a novel skate construction which establishes an extremely wide base of support for the skater, thus providing exceptional lateral stability. The skate construction thus reduces the reliance on ankle strength and sense of balance as is required for single blade skates.

The skate construction of the present invention includes a booth having a sole plate extending longitudinally between the toe portion and the heel portion of the boot. A pair of adjustable shock absorbing mounting assemblies is joined to the toe portion and the heel portion of the sole plate. A pair of ice engaging members is provided, each secured to one of the shock absorber mounting assemblies. The ice engaging members extend transversely with respect to the longitudinal axis of the boot to provide high lateral stability. Projecting downwardly from the lower surfaces of the ice engaging members is a plurality of laterally spaced, longitudinally extending ribs which are adapted to slide on ice.

The ice engaging members are secured to the shock absorbing mounting assemblies not only to absorb the impact forces that would otherwise be transmitted to the foot, but also to provide limited freedom of movement in the nature of rolling motion between the boot and the ice engaging members. As a result, the ribs of the ice engaging members may fully impinge upon the ice surface even when the weight of the skater is not directed perpendicularly to the ice.

DESCRIPTION OF THE PREFERRED EMBODIMENT

The present invention generally comprises a novel ice skate construction which provides exceptional lateral stability and support for the skater. With reference to the accompanying figures, the ice skate construction includes a boot 11 adapted to receive and secure the foot of the skater, and a base plate 12 extending from the toe portion 13 to the heel portion 14 of the boot. The plate 12 is secured to the lower surface of the sole and heel of the boot by rivets or other fasteners commonly employed in the construction of skates.

Figure 5:
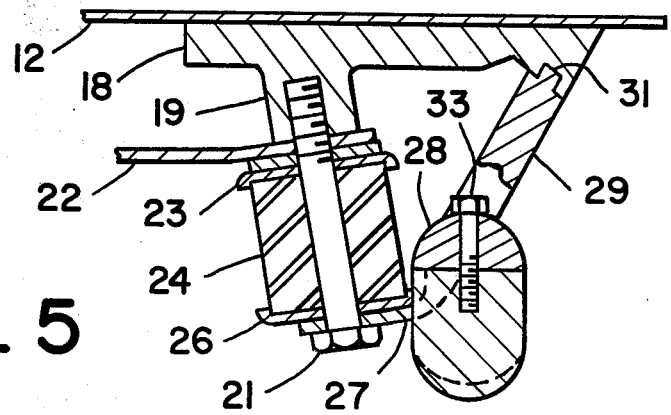
FIG. 5 is an enlarged cross-sectional elevation of the shock absorber mounting assembly of the present invention.

The invention also includes a pair of shock absorbing mounting assemblies 16 and 17 joined to and subjacently dependent from the toe portion and the heel portion of the base plate 12, respectively. With reference to FIG. 5, each of the assemblies 16 and 17 includes a mounting bracket 18 which includes a boss 19 extending downwardly therefrom. A bolt 21 is secured in a tapped hole within the boss 19. Assembled on the bolt 21 is a tongue 22 which extends between the assemblies 16 and 17 to provide added rigidity to the overall assembly. Also secured to the bolt 21 is a disc 23, a rubber gasket 24, and the plate portion 26 of a bracket 27. It may be appreciated that the bolt 21 joins the elements 23, 24, and 26 with a compressive force. The plate 26 impinges upon the resilient rubber annulus 24, and is therefore disposed for limited movement with respect to the bolt 21. The degree of movement of the plate 26 is selectively altered by tightening or loosening the bolt 21.

Extending from each of the brackets 27 are a pair of horizontal arms 28 extending outwardly in laterally opposed fashion. Also extending obliquely upwardly from each bracket 27 is a brace 29. The upper end of each brace is received in a socket 31 formed at the end of the bracket 18. The brace 29 is adapted to undergo limited pivoting movement within the socket 31, and serves to secure the member 27 in rigid fashion in the longitudinal direction, while at the same time permitting limited rolling motion (in the aeronautical sense) of the member 27 with respect to the members 22 and 18 which are securely affixed to the boot.

A most salient feature of the present invention is the provision of a pair of ice engaging members 32, each secured to one of the shock absorbing assemblies 16 or 17. It may be noted that the ice engaging members 32 are secured to the lateral arms 28 by means of bolts 33 or the like. The members 32 extend transversely with respect to the longitudinal axis of the skate, and also with respect to the intended direction of travel. Extending downwardly from the lower surface of the members 32 are a plurality of laterally spaced, longitudinally disposed recesses which define a plurality of ribs 34. Each of the ribs 34 acts as an individual blade or runner to contact the ice surface and support the skate in longitudinally slidable fashion.

Figure 1:
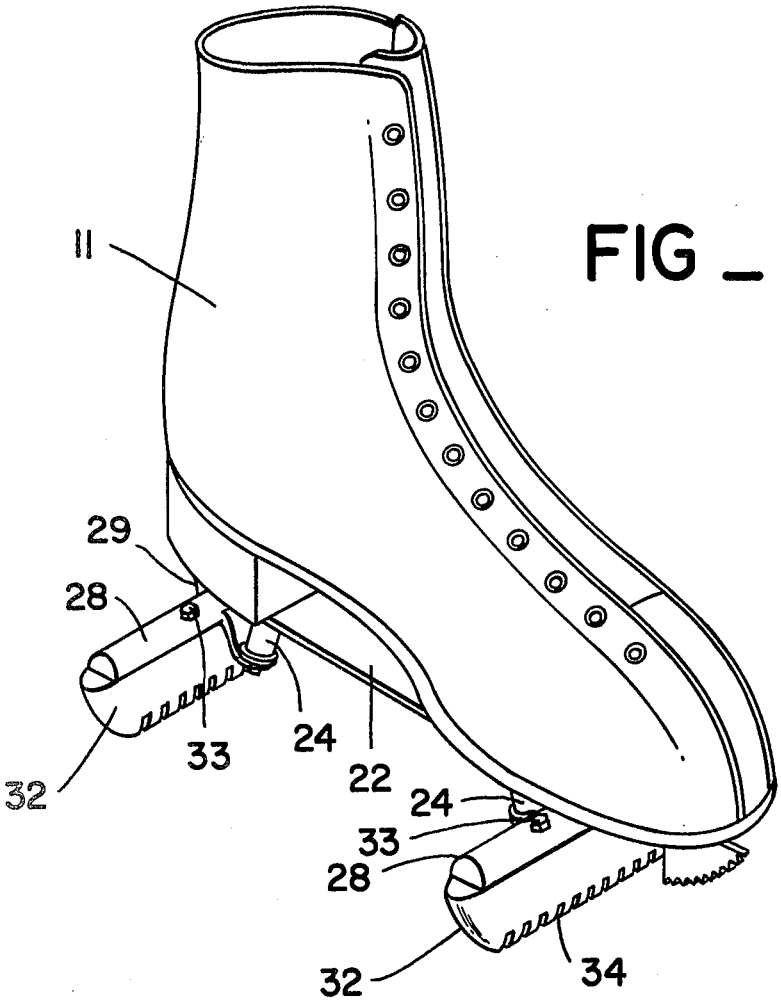
FIG. 1 is a perspective view of the ice skate construction of the present invention.
Figure 2:
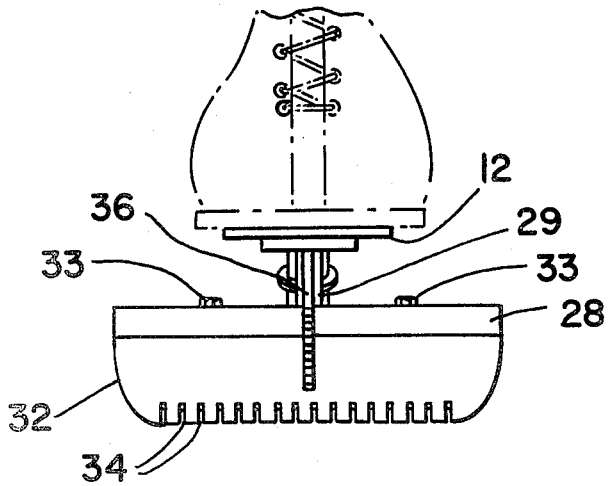
FIG. 2 is a front elevation of the ice skate construction of the present invention.
Figure 3:
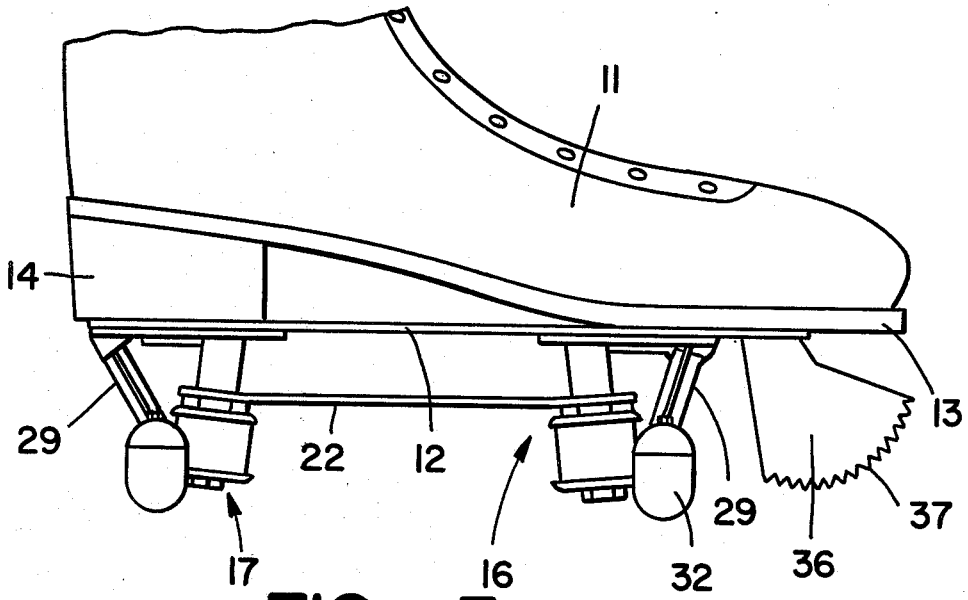
FIG. 3 is a side elevation of the ice skate construction of the present invention.
Figure 4:
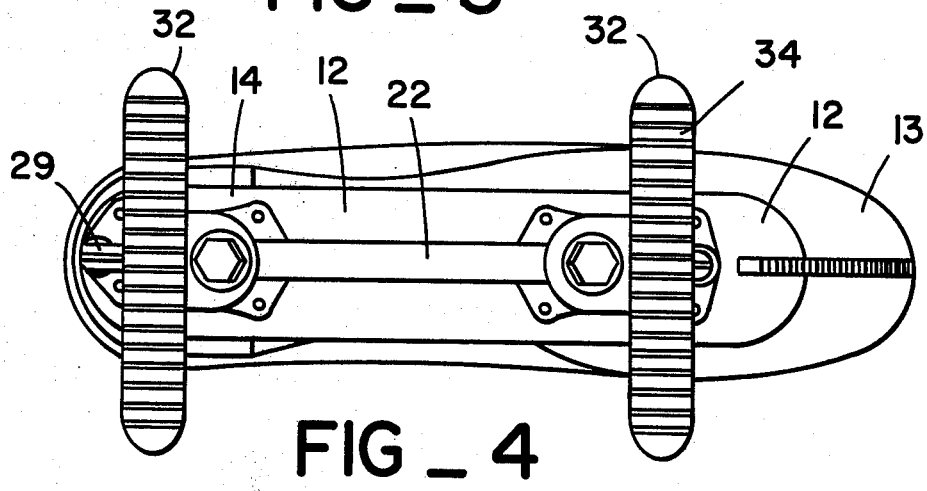
FIG. 4 is a bottom view of the ice skate construction of the present invention.

It may be appreciated that the members 32 extend laterally beyond the profile of the boot, as shown in FIGS. 2 and 4. The members 32 thus define a wide support base which provides exceptional lateral stability to the skate. At the same time, however, the total surface area of the ribs 34 impinging upon the ice is approximately the same as the total surface area of a typical single blade skate.

Furthermore, the members 32 are secured to the bracket member 27 by means of the lateral arms 28. Due to the limited degree of rolling motion of the member 27 with respect to the boot, the skater may lean to the left or right while proceeding in a forward direction while the lower surface of the members 32 remains in contact with the ice. Likewise, when the skate is lowered onto the ice during a skating stroke, the assembly is tolerant of obliquity between the plane of the ribs 34 and the surface of the ice.

The skate of the present invention may also include a stop member 36 secured to the toe portion of the plate 12 and extending obliquely downwardly and forwardly therefrom. The distal edge of the member 36 includes a plurality of teeth or serrations 37, which are adapted to engage the ice surface when the skate is tilted upwardly and forwardly by the skater. The engagement of the serrations 37 on the ice will quickly arrest any forward motion.

I claim:

1. An ice skate construction, comprising a longitudinally extending plate, a pair of ice engaging members, each secured to longitudinally opposed ends of said plate, each ice engaging member including a narrow, ice engaging lower surface, said ice engaging lower surface extending laterally and generally disposed transversely to the intended direction of travel, a plurality of recesses extending upwardly from said lower surface and spaced apart laterally therealong, said recesses defining a plurality of ribs, said ribs adapted to impinge on an ice surface in sliding fashion, and means for securing said plate to the foot of a skater.

2. The ice skate construction of claim 1, further including means for joining said ice engaging members to said plate with limited rolling motion therebetween.

3. The ice skate construction of claim 2, further including brace means for permitting only limited rolling motion between said ice engaging members and said plate.

4. The ice skate construction of claim 2, wherein said last mentioned means includes a pair of brackets, each including means for securing one of said ice engaging members thereto, and resilient means for joining said bracket to said plate.

5. The ice skate construction of claim 4, wherein said last mentioned means includes an elastomeric block interposed between each of said ice engaging members and said plate.

6. The ice skate construction of claim 5, further including means for adjustably compressing said elastomeric block to control the relative motion between said plate and said ice engaging member.

7. The ice skate construction of claim 4, further including a rigid member fixedly secured to and extending between like ends of said elastomeric blocks.

8. The ice skate construction of claim 4, wherein said means for securing said ice engaging members to said brackets includes a pair of laterally opposed arms extending outwardly from each of said brackets.

9. The ice skate construction of claim 1, wherein said laterally spaced recesses extend longitudinally in the intended direction of travel.

10. The ice skate construction of claim 1, further including a stop member extending downwardly and forwardly from the forward end of said plate.

* * * * *